US009409685B2

(12) United States Patent
Paz Luis

(10) Patent No.: US 9,409,685 B2
(45) Date of Patent: Aug. 9, 2016

(54) CUP FOR MAKING TEA ON THE GO

(71) Applicant: Francisco Paz Luis, Granada (ES)

(72) Inventor: Francisco Paz Luis, Granada (ES)

( * ) Notice: Subject to any disclaimer, the term of this patent is extended or adjusted under 35 U.S.C. 154(b) by 0 days.

(21) Appl. No.: 14/423,848

(22) PCT Filed: Aug. 27, 2013

(86) PCT No.: PCT/ES2013/000194
§ 371 (c)(1),
(2) Date: Feb. 25, 2015

(87) PCT Pub. No.: WO2014/033336
PCT Pub. Date: Mar. 6, 2014

(65) Prior Publication Data

US 2015/0225146 A1 Aug. 13, 2015

(30) Foreign Application Priority Data

Aug. 30, 2012 (ES) ..... 201200863

(51) Int. Cl.
*B65D 51/26* (2006.01)
*A45F 3/16* (2006.01)
*B65D 85/812* (2006.01)
(Continued)

(52) U.S. Cl.
CPC . *B65D 51/26* (2013.01); *A45F 3/16* (2013.01); *A47G 19/2272* (2013.01); *B65D 85/8085* (2013.01); *B65D 85/812* (2013.01)

(58) Field of Classification Search
CPC .... A47G 19/2272; B65D 51/26; B65D 51/24; B65D 85/8085; B65D 85/812; B65D 43/02; B65D 85/808; B65D 2081/001; B65D 2081/002; B65D 2081/004; B65D 2081/005; B65D 81/00
USPC ..... 426/77, 78, 79, 80, 81, 82, 83, 84, 425, 426/433, 435; 220/212; 99/322, 323
See application file for complete search history.

(56) References Cited

U.S. PATENT DOCUMENTS 1,723,702 A * 8/1929 Mitchell ..... 426/81
2,860,989 A * 11/1958 Geisinger ..... 426/83
(Continued)

FOREIGN PATENT DOCUMENTS

DE 29516601 U1 * 3/1996
ES 2314502 T 3/2009
(Continued)

OTHER PUBLICATIONS

DE 29516601 U1 Espacenet Machine Translation.*

*Primary Examiner* — Erik Kashnikow
*Assistant Examiner* — Ashley Axtell
(74) *Attorney, Agent, or Firm* — Ladas & Parry LLP

(57) ABSTRACT

The cup for making tea on the go is a cup and a pack comprising a lid, a refillable teabag, tab for lifting out the bag and an attachment system, that may be secured to the lid or be incorporated in the string, said attachment preventing the bag from falling into the beverage once the tea has been prepared and having a negative effect on the taste and properties thereof, and said pack may also include a spoon and a serving of sugar. The whole pack is provided in a sealed bag that guarantees hygiene and preserves the properties of the tea, so that it does not go stale. The main advantage of said cup is that it also serves as a teapot, so that there is no need to wait in the establishment that supplies the tea, waiting for the beverage to be prepared.

9 Claims, 6 Drawing Sheets

(51) Int. Cl.
*A47G 19/22* (2006.01)
*B65D 85/808* (2006.01)

(56) References Cited

U.S. PATENT DOCUMENTS 2,878,927 A * 3/1959 Haley ..... 426/80
2,887,037 A * 5/1959 Setecka ..... 99/295
3,861,284 A * 1/1975 Costello ..... 99/321
6,742,670 B1 6/2004 Portman et al.
7,140,510 B2 * 11/2006 Portman et al. ..... 220/712
7,845,509 B2 * 12/2010 Burchard ..... 220/254.1
7,913,867 B2 * 3/2011 Phillips ..... 220/254.2
8,181,817 B2 * 5/2012 Portman et al. ..... 220/712

FOREIGN PATENT DOCUMENTS

WO WO 0134486 A1 * 5/2001
WO WO 2012/309370 8/2012
WO WO 2012134403 A2 * 10/2012
WO WO 2012134403 A3 * 1/2013

* cited by examiner

CUP FOR MAKING TEA ON THE GO

CROSS-REFERENCE TO RELATED APPLICATION

This U.S. application claims priority under 35 U,S. 371 to, and is a U.S. National Phase application of the International Patent Application No. PCT/ES2013/000194, tiled 27 Aug. 2013, which claims the benefit of prior Spanish Application No. 201200863 filed 30 Aug. 2012. The entire contents of the above-mentioned patent applications are incorporated by reference as part of the disclosure of this U.S. application.

This invention refers to a tea cup, of the takeaway type, comprising a receptacle (cup), a lid from which a teabag hangs, and a mechanism for lifting said teabag, preventing it re-entering into contact with the liquid in the receptacle, once the sufficient number of minutes for its preparation have elapsed. This cup enables the user to move about with the drink without having to wait fir it to be prepared, as only the teabag needs to be separated from the liquid by means of the lifting mechanism while the user is in transit.

The lifting mechanism prevents the tea from remaining in contact with the liquid beyond the desired amount of time, since this could cause its flavour to change.

BACKGROUND OF THE INVENTION

There is currently a growing demand from consumers wishing to drink coffee or tea outside the establishments for such purposes, either because they are short of time or wish to enjoy their drink outdoors.

To date numerous take-away cups have been manufactured known as "take&away" for drinking coffee whilst travelling, on the way to work, or at work, yet no take-away tea cups have been manufactured. Tea needs to be prepared in advance, insofar as the teabag must not remain in contact with the beverage any longer than necessary, since this could alter its flavour.

Normally, when preparing tea, a teapot is used, into which water or hot milk are poured, adding a teaball or a teabag with the tea leaves or the desired preparation. After a few minutes, the liquid is separated from the tea leaves, either by pouring the contents of the teapot into available cups, or by removing from the teapot the preparation with the tea leaves. This step is essential, since failure to do so, will result in the tea spending more time than desired in contact with the liquid, thus altering the flavour of the beverage.

In the case of the tea cup in this invention, a teapot does not need to be used, as the cup will perform its function, insofar as the step of separating the tea from the liquid is solved by pulling the string from which the teabag hangs, from the lid exterior , in order to subsequently fix it in place and thus prevent the bag from descending and re-entering into contact with the beverage.

This invention simplifies the instruments required for the "ceremony" of preparing tea, reducing the amount of time required, which hitherto had made the concept of take-away tea unviable.

DESCRIPTION OF THE INVENTION

The amount of time that the tea must be in contact with the water or the milk, is crucial for enjoying a pleasant beverage that retains all of its properties, it is therefore not compatible with a beverage that is consumed on the go, since it requires calculated preparation.

With the take-away tea cup which is the subject of this invention, tea can be supplied in any fast-service beverage establishment or self-serve machine, since all that is needed is to pour hot water or milk over the cup and the procurement of a teabag containing the desired amount and variety of tea. In this way, a consumer's normal routine can continue without having to wait for the beverage to be prepared, as all that remains is to separate the teabag, once the recommended number of minutes have elapsed, by lifting it with the lifting mechanism.

The lifting mechanism consists of pulling the string, from which the teabag hangs, from the external face of the lid, with the help of a tab designed for this purpose, and anchoring the string to a notch or other form of fastening, so that the teabag being in contact with the inside of the lid, preventing it from descending and coming into contact with the prepared tea again, In this way, there is no need to immediately find a waste bin to throw away the teabag thus consumers can continue their normal activity.

The cup for preparing take-away tea comprises:

A cup, a lid with a mouthpiece from which the teabag with the chosen variety of tea hangs and an anchoring means that fastens the string connecting the teabag to the lid in place, in order to separate it from the liquid once the recommended number of minutes have elapsed.

BRIEF DESCRIPTION OF THE DRAWINGS

For an improved understanding of the above description, a series of drawings are attached hereto in order to clarify any doubts that may exist in this regard.

Figure 1:
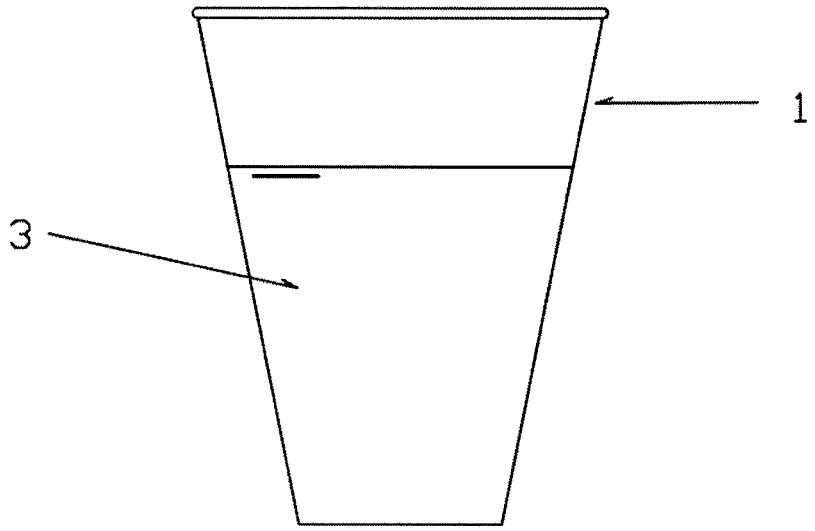
FIG. 1 is an elevational view of a cup suitable for use in the present invention.
Figure 2:
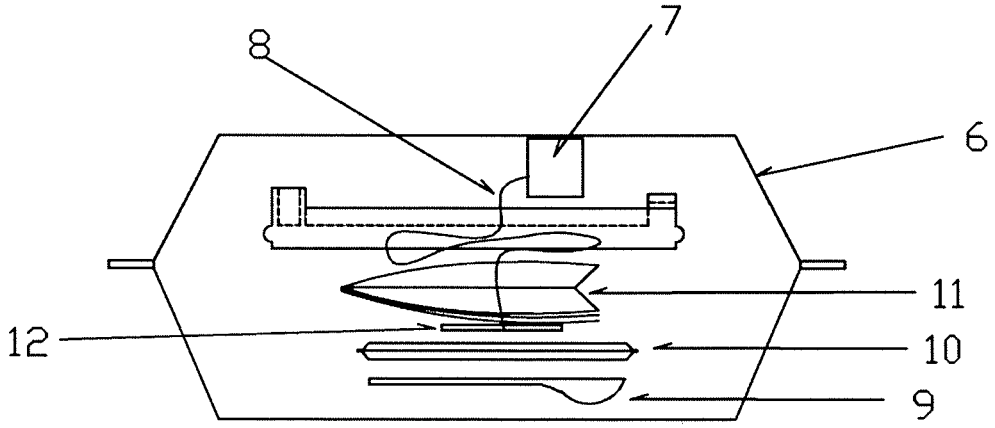
FIG. 2 shows a pack containg components for use in the present invention.
Figure 3:
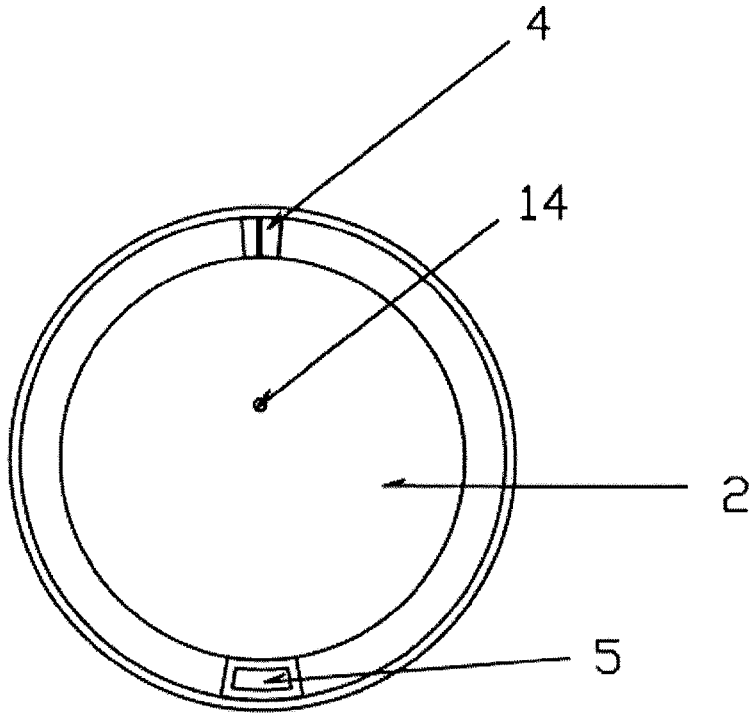
FIG. 3 is a top plan view of a lid for a cup of use in the present invention.
Figure 4:
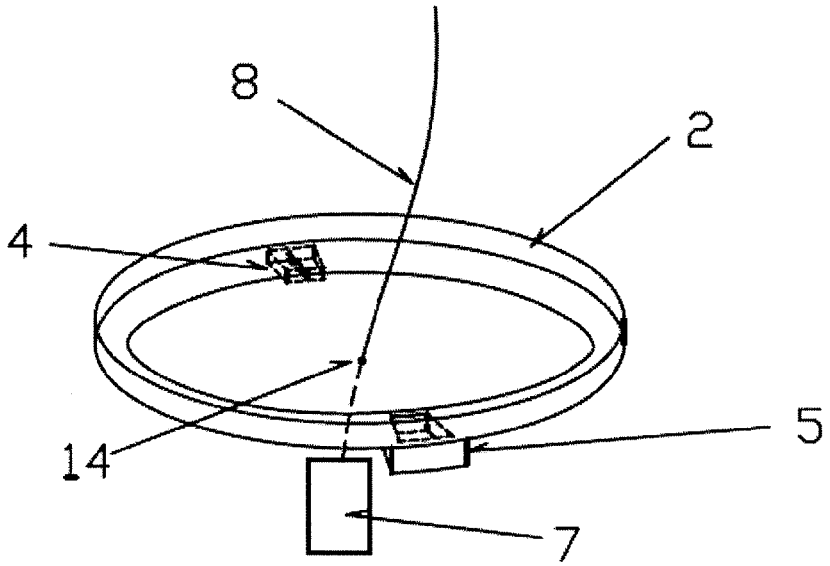
FIG. 4 shows a lid with a string for connecting a teabag to the lid passing through a hole in the lid.
Figure 5:
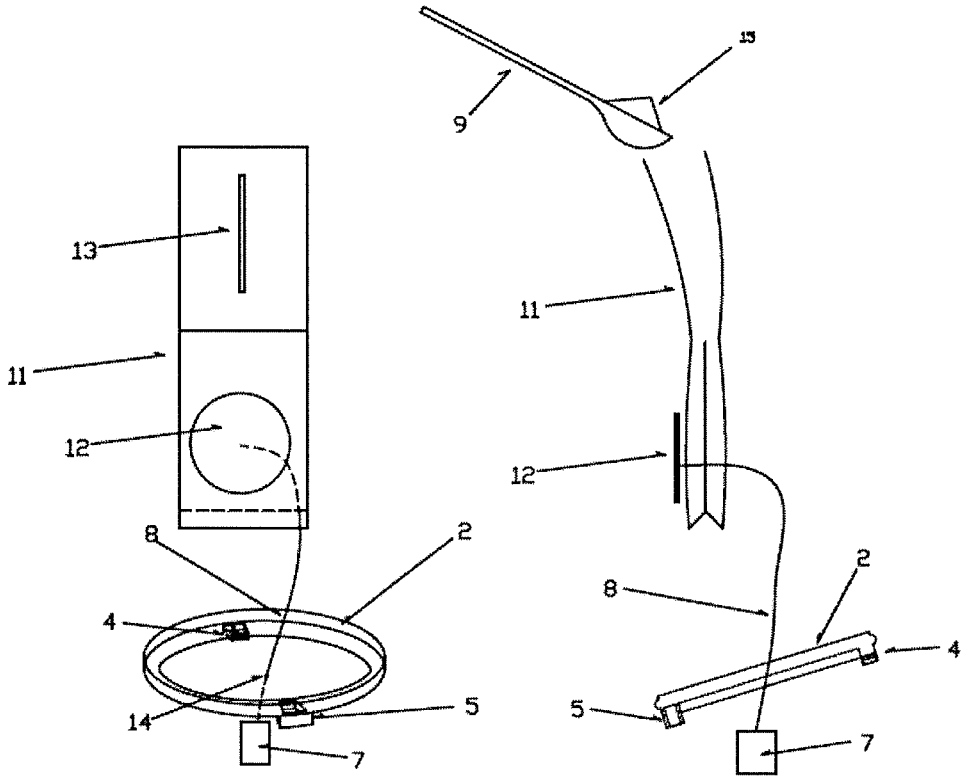
FIG. 5 shows front and side views of the assembly of the lid and teabag for placement on a cup.
Figure 6:
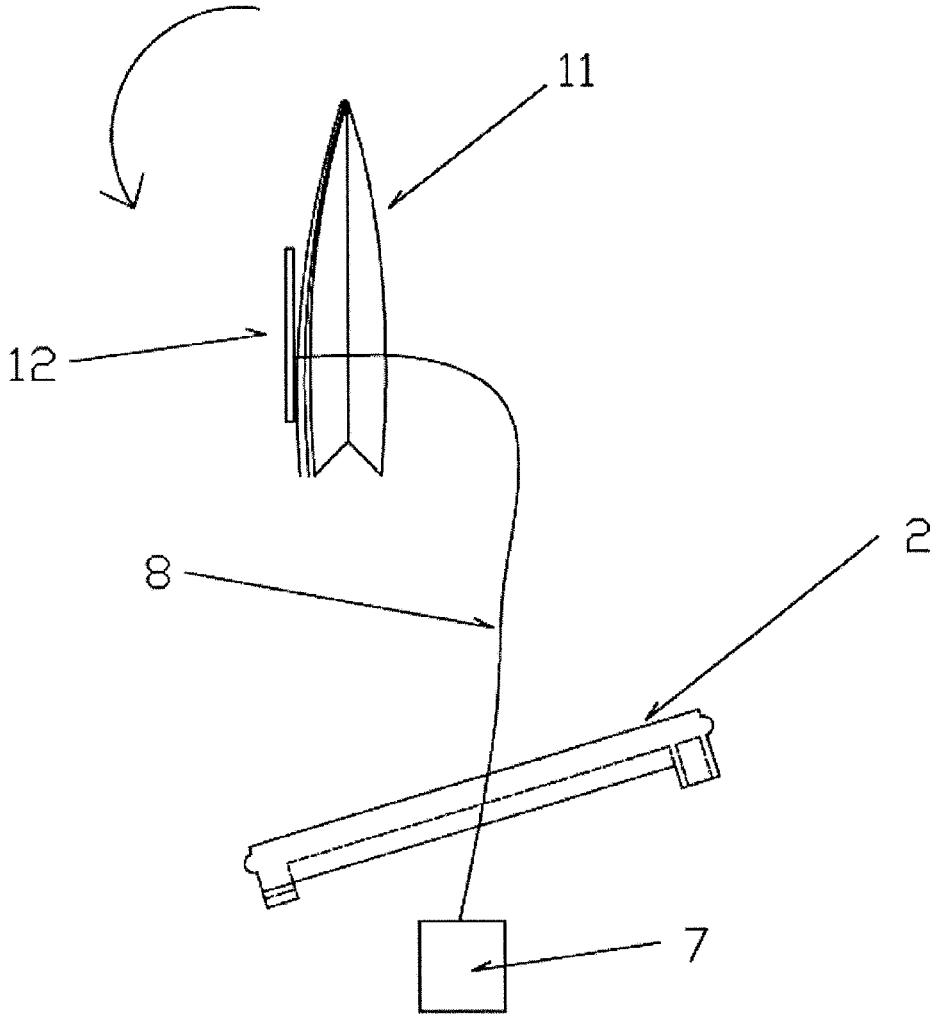
FIG. 6 shows a further view of the assembly of the lid and teabag for placement on a cup.
Figure 7:
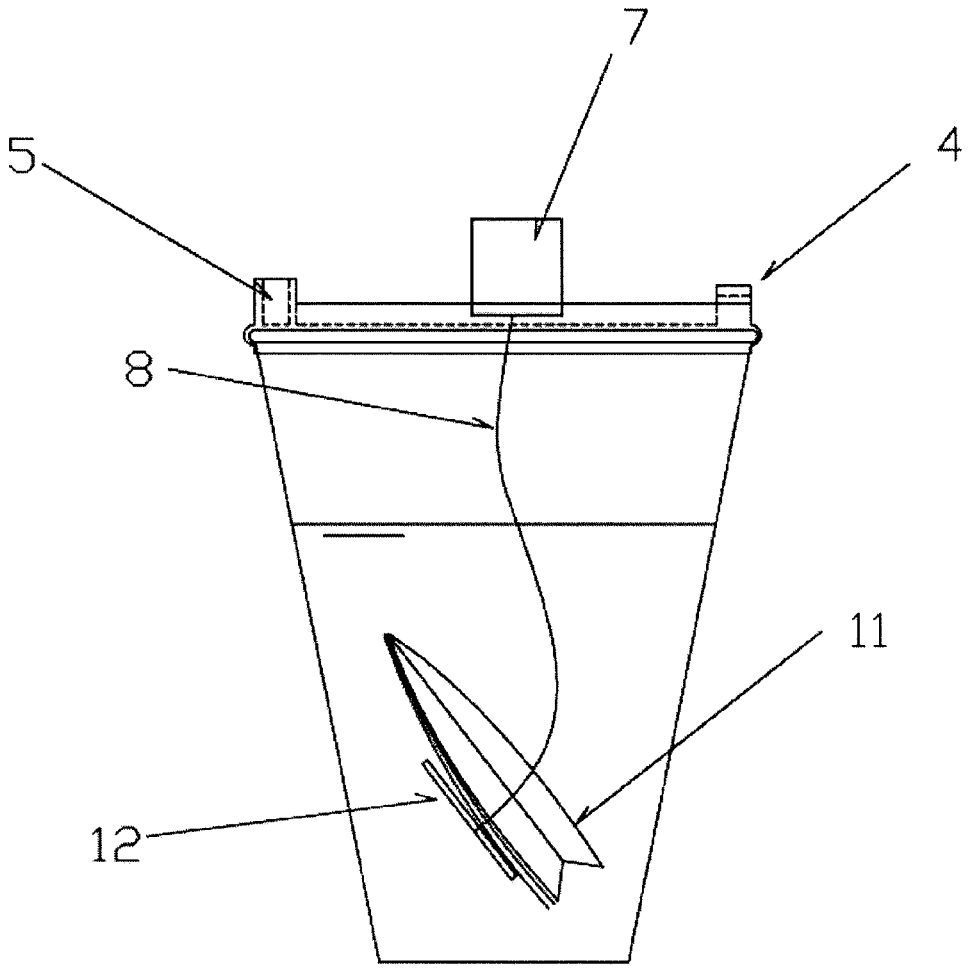
FIG. 7 shows he assembly of the lid and teabag in place on a cup.
Figure 8:
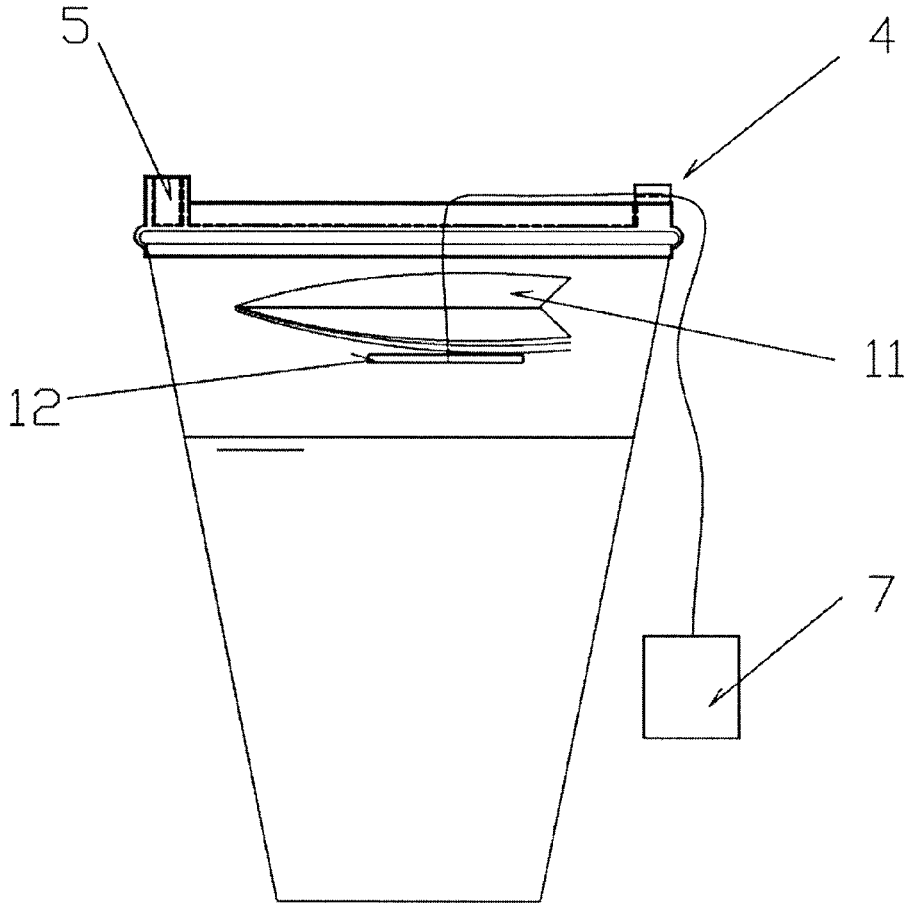
FIG. 8 shows he assembly of the lid and teabag in place on a cup after the string has been pulled to lift the teabag to a position proximate the lid.

Features shown in the figures bear the following reference numerals:

(1) Cup.
(2) Cup lid
(3) Liquid for the infusion.
(4) System for anchoring the string of the teabag,
(5) Mouthpiece of the lid.
(6) Hermetically sealed bag containing the lid, sugar, teaspoon and the serving of tea.
(7) Tab for lifting the teabag.
(8) String connecting the lid to the teabag.
(9) Teaspoon.
(10) Bag containing the sugar serving,
(11) Teabag.
(12) Rigid part for compressing the teabag.
(13) Eyelet in the teabag through which the rigid part (12) can pass and for closing the mouthpiece of the bag (11).
(14) Hole through which the string passes in order to lift the teabag.
(15) Tea serving.

DESCRIPTION OF A PREFERRED EMBODIMENT

An ideal procedure would consist of adding sugar to the liquid (milk or water), submerging the teabag, closing the lid, and after a few minutes have elapsed, pulling the string holding the teabag until it touches the inside of the lid, and then affixing said string to an anchoring means that prevents the teabag from descending and also prevents it from re-entering into contact with the prepared tea, thus altering the flavour of the beverage.

The cup for preparing take-away tea, comprises:

A cup (1)

A lid (2) from which the teabag (11) hangs. This arrangement may be supplied in a hermetically sealed bag (6), that retains the properties of the tea as well as facilitating transport and supply.

A tab (7) that enables the string (8) on which a teabag (11) hangs to be pulled from the outside of the lid.

An anchoring system (4) that enables the string (8) to be affixed after lifting the bag, preventing it from descending. This system could be a groove with teeth running against the grain. The anchoring system could take a number of different forms, therefore it is not possible to enumerate all the possible options herein.

Rigid part (12), in horizontal position, which permits the bag to be compressed against the inside of the lid when lifting.

Fillable teabag with an eyelet (13), through which the rigid part (12) passes, in order to prevent the contents of the bag from falling into the beverage. This extends the range of teas that could be provided in the supply establishment.

Logically, teabags could be supplied with the serving pre-prepared, using the habitual closing procedure (sealing, stapling. etc thus using a typical teabag, however in this case by keeping the rigid part and the connection at the centre of 25 the bag when the string is pulled, the bag will remain horizontal, and the tea will be prevented from entering into contact with the prepared beverage.

The invention does not include the materials used for manufacturing the components of the take-away tea cup, nor are the shape, dimensions and lifting and possible anchoring systems included, provided they do not affect its essential characteristics.

The invention claimed is:

1. Device for preparing tea-on-the-go comprising a cup (1), a lid (2) that fits on the cup, a teabag (11) and a teabag lifting mechanism comprising a string (8) that passes through the lid (2) and passes slidably through the teabag (11), one end of the string being attached to a pull tab (7) outside the cup (1) and the other end of the string to a separate rigid compressing member (12) whereby when the pull tab is pulled the rigid compressing member can compress the teabag against the inside of the lid (2).

2. Devise for preparing tea on the go according to claim 1 characterised in that it comprises an anchoring mechanism (4) for affixing the string (8) to the lid, which prevents the teabag (11) from descending, once it has been lifted, after the beverage has been prepared, with said anchoring mechanism located on the lid.

3. Device for preparing tea on the go according to claim 2, characterised in that the string (8) is connected to the teabag (11) in a zone that permits the teabag to remain in horizontal position when the teabag is lifted, thus reducing the possibilities of the bag entering into contact with the prepared beverage.

4. Device for preparing tea on the go according to claim 2, characterised in that the teabag (11) comprises an eyelet (13) near an opening where the tea is inserted, with the teabag (11) being sufficiently elongated such that with the desired serving of selected tea inside and at the bottom, the top of the teabag (11) which is not in contact with the tea can be folded against the part of the teabag that is in contact with the tea, with the eyelet (13) aligned with the rigid compressing member (12), so that pulling up the string (8) once the rigid compressing member (12) is passed through the eyelet (13) ensures that the teabag (11) remains closed, preventing its contents from escaping.

5. Device for preparing tea on the go according to claim 1, characterised in that the string (8) is connected to the teabag (11) in a zone that permits the teabag to remain in a horizontal position when the tea bag is lifted, thus reducing the possibilities of the bag entering into contact with the prepared beverage.

6. Device for preparing tea on the go according to claim 1, characterised in that the teabag (11) comprises an eyelet (13) near an opening where the tea is inserted, with the teabag (11) being sufficiently elongated such that with the desired serving of selected tea inside and at the bottom, the top of the teabag (11) which is not in contact with the tea can be folded against the part of the teabag that is in contact with the is with the eyelet (13) aligned with the rigid compressing member (12), so that pulling up the string (8) once the rigid compressing member (12) is passed through the eyelet (13) ensures that the teabag (11) remains closed, preventing its contents from escaping.

7. Device for preparing tea on the go according to claim 1, characterised in that the lid (2) and the teabag (11) with the lifting mechanism are supplied in a pack within a hermetically sealed bag.

8. Device for preparing tea on the go according to claim 7, characterised in that the pack includes a teaspoon (9).

9. Device for preparing tea on the go according to claim 7, characterised in that the pack includes sugar (10).

* * * * *